United States Patent [19]

Holden

[11] Patent Number: 4,920,896

[45] Date of Patent: May 1, 1990

[54] PORTABLE GAME TABLE ARM CUSHION

[76] Inventor: Virginia Holden, 6623½ Crenshaw Blvd., Los Angeles, Calif. 90043

[21] Appl. No.: 235,565

[22] Filed: Aug. 24, 1988

[51] Int. Cl.[5] ..... A47B 13/08

[52] U.S. Cl. ..... 108/90; 248/345.1; 297/411; 297/413

[58] Field of Search ..... 108/27, 90; 5/424; 49/462; 248/345.1, 118, 118.1, 687; 312/137; 297/394, 399, 400, 401, 411, 414, 415, 412, 413, 422

[56] References Cited

U.S. PATENT DOCUMENTS

| | | | |
|---|---|---|---|
| 360,540 | 4/1887 | Russack | 297/414 |
| 438,279 | 10/1890 | Rowlett | 297/414 |
| 510,282 | 12/1893 | Moody | 297/414 |
| 1,212,514 | 1/1917 | Lathrop et al. | 248/345.1 |
| 1,890,102 | 12/1932 | Urquhart | 297/415 |
| 2,292,445 | 8/1942 | Hilldring | 248/345.1 |
| 2,685,472 | 8/1954 | Adell | 49/462 |
| 3,300,250 | 1/1967 | Dollgener et al. | 248/118 |
| 3,523,710 | 8/1970 | Barecki et al. | 248/345.1 |
| 4,117,782 | 10/1978 | Cahill | 108/27 |
| 4,370,373 | 1/1983 | Janicz | 248/345.1 |
| 4,592,584 | 6/1986 | White, Jr. | 248/118 |
| 4,724,561 | 2/1988 | Falwell et al. | 248/345.1 |

*Primary Examiner*—Kenneth J. Dorner
*Assistant Examiner*—Brian K. Green
*Attorney, Agent, or Firm*—Paul H. Ware

[57] ABSTRACT

A portable game table arm cushion for providing a comfortable support for a user's forearms, the cushion being removably attachable to the forward edge of a desk or table by means of insertable clips, said cushion being conveniently portable by means of being foldable into convenient lengths so as to fit into a purse or handbag. The cushion may be economically produced in any number of unitary or variable length segments so as to make up a composite cushion of any desired overall total length.

2 Claims, 1 Drawing Sheet

10
12
14
16
18
20
22
24
26
28
3
4

PORTABLE GAME TABLE ARM CUSHION

BACKGROUND OF THE INVENTION

1. Field of the Invention

This invention relates generally to portable cushioned arm rests for application to the forward edges of desks or tables and more particularly to easily portable arm rests that may be carried about in a purse or handbag or the like.

2. Description of the Related Art

Cushioned arm rests are known in which the forearms may be protected from abrasive contact with the edge of a desk or table while engaged in some activity thereupon. While presently available devices can, in fact, alleviate the discomfort attendant to resting the forearms on a desk or table while engaged in some activity requiring that position, some disadvantages of these prior art devices, among other things, reside in their lack of convenient portability or perhaps their permanent attachment to the desk or table. Most of the prior art devices, employed in the attempts to solve the problems presented, have either presented new problems or only partially solved these problems or both. These prior art devices, among other disadvantages, have been expensive and complicated to manufacture. One of these prior art devices has been described in the following patent that was brought to the attention of the applicant through a novelty search conducted in the United States Patent and Trademark Office.

U.S. Pat. No. 3,300,250 was granted to R. W. Dollenger, et al on Jan. 24, 1967, for ARM REST FOR DESK AND BENCH WORKERS. The reference device provided a permanently attached arm rest cushion of comparatively complicated manufacture.

It would thus be a great advantage to the art to provide an economical, uncomplicated and easily portable arm rest.

A further desirable advantage would be realized by the provision of an arm rest that is easily removably attachable to the edge of a game table or desk or the like.

SUMMARY OF THE INVENTION

It is an object of the present invention to provide an economical, uncomplicated and easily portable table or desk arm rest.

An additional object of the invention is to provide an arm rest that is easily removably attachable to the edge of a game table or desk or the like.

In the accomplishment of these and other objects a game table arm cushion is provided that is removably attachable to a game or other desk or table edge by means of insertable clips. The inventive device is effective to relieve forearm abrasion and fatigue and prevents forearm sores resulting from leaning on the hard surface edge of a gaming or other table or desk or the like. Thus the device enhances a user's concentration on the process in progress by relieving discomfort. The device is inexpensive and is conveniently portable in purse or handbag.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings wherein like reference characters refer to like parts throughout and in which:

FIG. 1 is a perspective illustration showing a user with the game cushion in place.

FIG. 2 is a perspective drawing showing how the device may be folded for easy portability and also the means utilized to attach it to a table or the like.

FIG. 3 is an enlarged detail drawing taken along the sight lines 3—3 of FIG. 2.

FIG. 4 is an enlarged detail drawing taken along the sight lines 4—4 of FIG. 1.

DETAILED DESCRIPTION

Figures 1, 2, 3, 4:
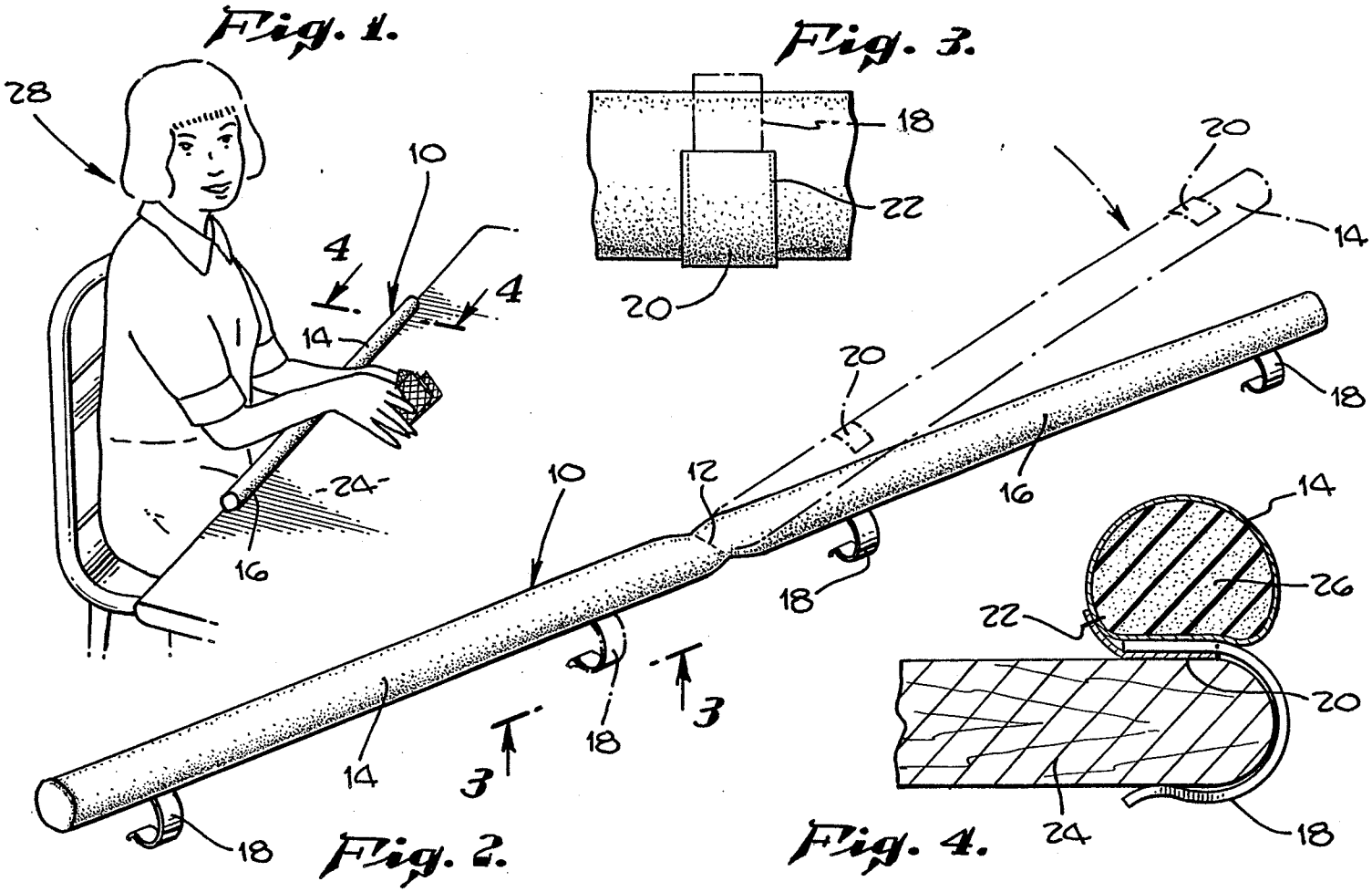

Although specific embodiment of the invention will now be described with reference to the drawings, it should be understood that such embodiments are by way of example only and merely illustrative of but a small number of the many possible specific embodiments which can represent applications of the principles of the invention. Various changes and modification, obvious to one skilled in the art to which the invention pertains, are deemed to be within the spirit, scope and contemplation of the invention as further defined in the appended claims.

Referring to FIG. 1 with greater particularity, the portable game table arm cushion is denoted generally by the numeral 10. A user 28, is shown as engaged in a game of cards upon a table 24. The game table arm cushion, as may be more readily seen in FIG. 2, is divided into two parts, foldable one upon the other at a fold line or crease 12 and in which a first elongated cylindrical cushion portion separated from another portion by said fold line or crease; is identified by numeral 14 with a second elongated cylindrical cushion portion identified by numeral 16. It is emphasized that two separated portions have been shown merely to present an enabling disclosure and not as a limiting configuration. Thus, any number of elongated cylindrical cushion portions so separated is contemplated by the invention.

FIG. 2 again denotes the device generally by the numeral 10. A fold line 12 is shown as separating the first elongated cushion portion 14 from second elongated cushion portion 16. It is obvious that in a multi-cushion structure, additional fold lines such as 12 will separate the cushion portions. Table edge clips 18, each being of a general U shape having a straight leg, a rounded portion and another leg having an outwardly tending portion, are adaptable to be easily removed from pockets 20 and to removably attach the device 10 to the edge of a desk or table or the like. The portion of the drawing shown in phantom illustrates the folding of the device with table edge clips 18 removed from clip pockets 20 preparatory to storing in handbag or purse. Said clip pockets 20, as may be more readily understood by reference to FIG. 4, have an open end adapted to receive the straight leg of table edge clips 18 and a closed end, thus forming a sheath for retention of said clips so as to enable the placing in position of the cushion at the table edge. Details of the clip pockets 20 may be more readily understood by reference to FIG. 3.

FIG. 3 is a detail taken along sight line 3—3 of FIG. 2 showing the clip pocket 20 with its open end upward to receive a table edge clip therein and with its stitching 22 and showing an inserted table edge clip 18 in phantom. Thus it is shown that as many clips and clip pockets may be provided as required by a multi-cushion structure and that these clips may be removably inserted into the clip pockets provided.

FIG. 4, an enlarged illustration taken along the sight lines 4—4 of FIG. 1, provides a profile detail of the installation of the device at the edge of a table 24. A table edge clip 18, inserted into its clip pocket 20 at the open end thereof and extending therein to its closed end, is shown as securing the cushion portion 14 to table 24. The cushion filler 26 may be of any suitable material such as foam or the like.

Thus, there has been described a game table arm cushion that will provide an inexpensive, uncomplicated and easily portable arm rest. The game table arm cushion is easily removably attachable to the edge of a game table or desk or the like.

It is pointed out that although the present invention has been shown and described with reference to particular embodiment, nevertheless, various changes and modifications, obvious to one skilled in the art to which the invention pertains, are deemed to lie within the purview of the invention.

ABSTRACT OF THE DRAWINGS

In the drawings, the numbers refer to like parts and, for the purpose of explication, set forth below are the numbered parts of the elements of this invention.

| IDENTIFYING NUMERAL | NAME OF ELEMENT | SHOWN IN FIGS. |
|---|---|---|
| 10 | Game arm pad generally | 1, 2 |
| 12 | Fold | 2 |
| 14 | First Cushion Portin | 1, 2, 4 |
| 16 | Second Cushion Portion | 1, 2 |
| 18 | Table Edge Clips | 2, 3, 4 |
| 20 | Clip Pockets | 2, 3, 4 |
| 22 | Stitching | 3 |

-continued

| IDENTIFYING NUMERAL | NAME OF ELEMENT | SHOWN IN FIGS. |
|---|---|---|
| 24 | Table | 1, 4 |
| 26 | Cushion filler | 4 |
| 28 | User | 1 |

What is claimed and desired to be secured by Letters Patent of the United States is:

1. A portable game table arm cushion adaptable to be easily removably attached at the edge of a game table for protecting a user's forearms from irritation and abrasion when leaning against the edge of a game table, comprising:

a plurality of elongated cylindrical cushion portions in which a fold is fabricated between each portion effective to divide said cushion into convenient folding lengths;

at least a pair of clip pockets fabricated into each of said at least one elongated cylindrical cushion portions, each of said clip pockets having an open end and a closed end so as to form an open-ended sheath perpendicular to a longitudinal axis of said elongated cylindrical cushion portion;

a plurality of generally U-shaped table edge clips each having a straight leg, a rounded portion and another leg having an outwardly tending portion and each of which is adapted for insertion of its straight leg into said open end of one of said clip pockets;

whereby said game table arm cushion may be removably attached to a game table by means of said generally U-shaped table edges clips.

2. The device of claim 1 wherein said straight leg of said table edge clips may be inserted into the open end of said clip pockets for attachment of said cushion to said table edge and may also be removed from said clip pockets for rendering said cushion in a portable configuration.

* * * * *